United States Patent [19]

Aoki et al.

[11] 4,033,728

[45] July 5, 1977

[54] SYNTHETIC CAKING COAL AND METHOD FOR PRODUCTION THEREOF

[75] Inventors: Yutaka Aoki, Tokyo; Akira Hase, Kawasaki; Jiro Ito, Kamakura, all of Japan

[73] Assignee: Nissho-Iwai Co., Ltd., Japan

[22] Filed: Nov. 6, 1975

[21] Appl. No.: 629,536

[30] Foreign Application Priority Data

Nov. 11, 1974 Japan ..... 49-129799

[52] U.S. Cl. ..... 44/1 R; 208/10; 260/695

[51] Int. Cl.[2] ..... C10L 9/10; C10G 1/06

[58] Field of Search ..... 44/1 R; 208/10; 260/695

[56] References Cited

UNITED STATES PATENTS

| | | | |
|---|---|---|---|
| 3,185,635 | 5/1965 | Creglow | 44/1 R |
| 3,507,775 | 4/1970 | Breton et al. | 260/695 X |
| 3,725,246 | 4/1973 | Kmecak et al. | 208/10 X |
| 3,840,456 | 10/1974 | Yavorsky et al. | 208/10 |
| 3,852,183 | 12/1974 | Snell | 208/10 |

*Primary Examiner*—Carl F. Dees
*Attorney, Agent, or Firm*—Stevens, Davis, Miller & Mosher

[57] ABSTRACT

Synthetic caking coal obtained by hydrogenating weakly caking or non-caking coal and then subjecting the thus treated coal to heat polymerization preferably in a nonoxidizing atmosphere, and also relates to a method for production of such synthetic caking coal.

8 Claims, 1 Drawing Figure

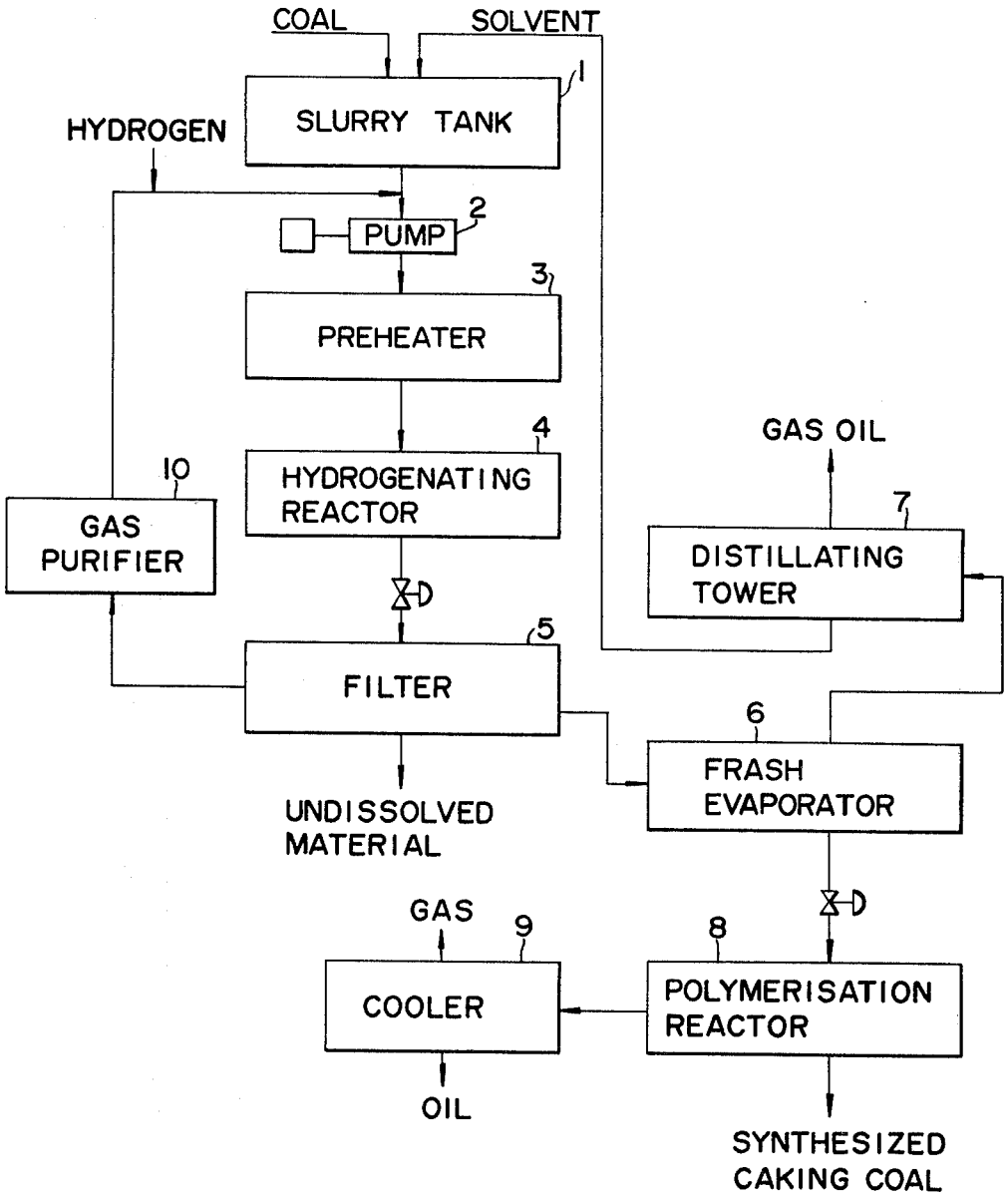
COAL
SOLVENT
SLURRY TANK
1
HYDROGEN
PUMP
2
3
PREHEATER
4
HYDROGENATING REACTOR
10
GAS PURIFIER
GAS OIL
7
DISTILLATING TOWER
5
FILTER
6
FRASH EVAPORATOR
UNDISSOLVED MATERIAL
GAS
9
8
COOLER
POLYMERISATION REACTOR
OIL
SYNTHESIZED CAKING COAL

SYNTHETIC CAKING COAL AND METHOD FOR PRODUCTION THEREOF

BACKGROUND OF THE INVENTION

1. Field of the Invention

This invention relates to a method of producing caking coal from non-caking or weakly caking coal. As is well known, caking coal or strongly caking coal is essential to production of coke used for iron manufacture. The price of caking coal has risen annually and presents the iron manufacturing industry with a serious problem. The worldwide caking coal or strongly caking coal reserves are very limited as compared with non-caking or weakly caking coal reserves and total depletion of such caking coal reserves is even considered likely in the near future. By the present invention the inventors intend to provide a means for coping with this situation by a method for obtaining (from non-caking or weakly synthetic caking coal) caking coal which compares well in quality with natural caking coal.

Caking coal and non-caking coal differ widely from each other in both physical and chemical properties. As regards the chemical composition, a striking difference is seen in oxygen content. For example, the oxygen content of Yallourn coal, which is a non-caking coal produced in Australia, is as high as 28% whereas that of strongly caking coals produced in the U.S. is as low as 2 to 3%. Oxygen content of weakly caking coals produced in Japan is within the range of 6 to 8%. Various attempts have been made to obtain caking coal by removing or reducing oxygen in non-caking coal down to the level of caking coal, but no successful result has been reported.

This invention has been accomplished on the basis of the discovery that caking coal can be produced from non-caking or weakly caking coal by first liquefying raw coal by hydrogenation and then subjecting the thus treated coal to heat polymerization.

2. Description of the Prior Arts

Liquefaction of coal has been known and practised since before the 2nd World War, and more recently deeper studies on this subject have been carried out, in the United States and Germany and some significant results have been made public. The basic techniques for liquefaction of coal were already completely worked out before the 2nd World War, and at present, studies are being made for improvement in the minute details. No specific techniques are required for liquefaction of coal used in the present invention, but any known coal liquefaction technique can be employed.

As Japan depends almost entirely on imports from foreign countries for its supply of caking coal, efforts have been concentrated on methdos for obtaining equivalents of caking coal by polymerizing or pyrolizing heavy oil residue which are abundantly available in Japan, and some successful results have been made public. However, there is not yet known any method for obtaining caking coal by liquefying raw coal and then polymerizing the liquefied product.

Regarding to polymerization of heavy oil residuum, the following literature is available:

1. Cokes Circulars 23, No. 2, pp 77 – 81 (1974) by K. Kiritani et al.: "A Study on Application of Petroleum Heavy Oil to Metallurgical Coke".

2. Journal of the Fuel Society of Japan, 51, No. 544(Aug. 1972) by Y. Kiritani et al.: "Production of Improved Strongly Caking Coal from Specific Petroleum Pitch".

The above-mentioned reference No. 1 discloses the fact that petroleum heavy oil can be used as raw material for metallurgical coke, by examining heavy oil heat treatment conditions and fluidity of specimens using a plastometer. Reference 2 shows the fact that an improvement of quality of coke can be attained by first subjecting raw oil to a shorttime decomposition treatment at a temperature of about 2,000° C, then blending the obtained specific pitch as caking agent in an amount of 20 to 40% in non-caking coal, and then subjecting the mixture to hot briquetting.

There has however not been known a method for obtaining synthetic caking coal by liquefying raw coal and then heat-polymerizing the liquefied coal.

SUMMARY OF THE INVENTION

It is therefore an object of the present invention to provide synthetic caking coal prepared from weakly caking or non-caking coal by hydrogenating such coal to convert it into low-molecular weight product and then further subjecting the said low-molecular weight material to heat polymerization to again increase its molecular weight.

It is another object of the present invention to provide a method for producing said synthetic caking coal from weakly caking or non-caking coal.

It is still another object of the present invention to provide blast furnace coke by blending said synthetic caking coal with weakly caking coal and then coking the mixture by a known method.

The other objects and advantages of the present invention will be easily understood by those skilled in the art from the following detailed description of the preferred embodiments of the invention and the appended claims.

BRIEF DESCRIPTION OF THE DRAWINGS

The drawing is a flow sheet showing the process for producing synthetic caking coal from nonor weakly caking coal according to the method of the present invention.

DESCRIPTION OF THE PREFERRED EMBODIMENTS

Removal or reduction of oxygen in coal may be accomplished by for instance applying heat to coal or treating it with chemicals, but such treatment causes a considerable change in the quality of the coal through decomposition of coal components or decrease in the molecular weight of the coal so that there results a decrease in the plasticity of the coal, a factor essential to caking capability.

The present inventors, through prolonged and detailed studies, have succeeded in obtaining excellent caking coal by decreasing the oxygen in coal to a required level while allowing decomposition of coal and/or decrease of molecular weight of coal to take place during oxygen removal, and then subjecting the obtained low-molecular product to polymerization to again increase the molecular weight. More particularly, according to the present invention, non-caking coal or weakly caking coal is first hydrogenated to remove oxygen in the coal to a required level and then the obtained product is subjected to heat polymerization, thereby obtaining good caking coal.

The method of the present invention comprises a hydrogenation step (first step) and a polymerization step (second step). In the hydrogenation step, there takes place a molecular weight reducing reaction to get rid of oxygen as well as sulfur. This is extremely advantageous from the viewpoint of preventing pollution and increasing iron manufacturing efficiency. In the first step it is possible to adjust the degree of reduction of molecular weight by changing the degree of hydrogen absorption by suitably selecting the pressure and temperature under which hydrogenation is conducted. Though for the operation in the second polymerization step it is desirable that the material for the second step, namely the product of the first step, contain high-molecular weight component in higher amount than the low-molecular weight component, it is convenient for easier treatment in the second step to use a material having a medium molecular weight.

The degree of reduction of molecular weight of the product obtained in the first step of hydrogenation can be known by measuring the melting point of the product. The intermediate product obtained in the first step desirably has a melting point of about 80° to about 180° C (measured by the ring and ball method), preferably from about 100° to about 150° C.

The above-mentioned hydrogen decomposition step (the first step) is carried out by first finely dividing raw coal into particles having a diameter less than 1.5 mm, then slurrifying these particles in a solvent such as anthracene oil and then subjecting the slurry to hydrogenation under agitation or shaking in the presence of a catalyst batch-wise or continuously. Hydrogenation is performed under hydrogen pressure of about 70 to about 150 atm and at a temperature of about 350° to about 500° C until an intermediate product having a predetermined melting point is obtained. Usually, the desired intermediate product can be obtained at a hydrogen absorption of about 0.5 to 3 weight % based on raw coal in the reaction time of 30 minutes to one hour.

Unless otherwise specified, it is possible to conduct a desirable hydrogenolysis using conditions which have generally been employed for hydrogenation of coal. However, it is advisable to use a catalyst which is rather slow in action because too violent hydrogenolysis reaction results in reduced amount of aromatic component and increased naphthene content. It is most desirable to use an Fe or Co-Mo type catalyst such as iron itself or an iron compound like iron sulfide, etc. It also proves effective to use iron sulfide contained in ash of coal or red mud produced in the manufacture of alumina. The catalyst is used preferably in an amount of 0 to 2.5 weight % based on the amount of raw coal. As for raw coal, any sort of weakly caking or non-caking coal there can be used, for example, brown coal produced in Australia, or Miike coal or Yubari coal produced in Japan, but it is preferred to use coal which contains small amount of inert components as determined by coal structure analysis. The hydrogenation reaction conditions used depend somewhat on the properties of the raw coal used. Generally, young coal is high in reactivity but contains oxygen in abundance, so that in case of using such young coal, it is necessary to carry out the reaction for a prolonged period of time at a relatively low temperature. Although raw coal usually requires no pre-treatment, it is desirable to perform coal washing when the raw coal contains ash in great quantity. Such coal washing can turn raw coal into clean coal with reduced inert component and favorable properties.

As a result of the hydrogenolysis reaction, a part of the organic sulfur in coal is combined with hydrogen to become hydrogen sulfide while organic oxygen is converted into water and thereby removed. The kind, properties and reaction conditions of raw coal are exemplified in the following table.

| Raw coal | Component | | | Hydrogenation conditions | | | Primary product |
|---|---|---|---|---|---|---|---|
| | Moisture (%) | Ash (%) | Volatile (%) | Press. (atm) | Temp. (° C) | Catalyst | yield % |
| Briquette (Prod. in Australia) | 15 | 1.6 | 42 | 70 | 450 | none | 62 |
| HABORO (brown coal prod. in Japan) | 13.5 | 7.1 | 41.4 | 150 | 400 | iron sulfide | 83 |
| HOBONAI (brown coal prod. in Japan) | 4.8 | 7.6 | 41.1 | 80 | 380 | iron | 85 |

After completion of the reaction, the hydrogenation product dissolved in the solvent is filtered to filter off the un-dissolved substances and ash and then subjected to distillation to recover distillate, and the hydrogenated product is obtained in a state of melting. The distillate contains solvent and light oil. The solvent is circulated for reuse, after separation of light oil components.

In the above-said hydrogenation step, the hydrogenation reaction can, as well known, be advantageously advanced without using any catalyst by carefully selecting the reaction conditions. That is, it is possible to obtain an intermediate product the same as that obtainable when using a catalyst, and this intermediate product is subjected to the second step to obtain caking coal having excellent swelling properties, and fluidity and appropriate volatility. Non-catalyst hydrogenation is usually carried out under the following conditions:

70 – 150 atm., and 450 – 500° C

In the case of no catalyst, hydrogenation is conducted under somewhat severer conditions than when using a catalyst, as by prolonging the reaction time, whereby it is possible to obtain the same product as when a catalyst is used.

In the second polymerization step, the intermediate product obtained in the first step is polymerized by heat polymerization in the presence or absence of a catalyst such as aluminum choride to increase the molecular weight, and thereby obtain a polymerization product having a suitable volatile content, dilatation degree, and fluidity. No addition of catalyst is usually required, but it is desirable to use a catalyst in case the product in the first step contains nephthene in abundance. This reaction is a polymerization reaction so that the reaction is preferably carried out under an inert or reducing atmosphere such as an $N_2$ or $CO_2$ stream. The low-molecular product which has been desulfurized and deoxygenized by the hydrogenation reaction in the first step is not subjected to polymerization reaction at a fairly high temperature such as 450° C and is thereby again increased in its molecular weight. The method of this invention has a striking difference from the polymerization of heavy petroleum residuum in that the polymerization reaction can usually be carried out without using any catalyst in the method of the present invention. Therefore, the important factors in the second step are temperature and time, so that there can be obtained synthetic caking coal having various degrees of volatile content, dilatation and fluidity by suitably selecting these operating conditions.

The polymerization reaction is usually carried out at the temperature of from about 350° to about 500° C, preferably from about 380° to about 450° C. Under these conditions excellent results can be obtained by a treatment of 60 to 80 minutes. Consequently the obtained synthetic caking coal has volatile content of 12 to 32%, preferably 20 to 30%, dilatation of 4 to 9 (CSN) and fluidity of 20,000 to 30,000 ddpm. Upon completion of the polymerization reaction, the product is immediately discharged, cooled and then crushed for use. Industrially, the polymerization reaction is carried out for example in a delayed coker or other like means and the product is cut out from the coke drum by high-pressure water jet. As the obtained synthetic synthetic caking coal has excellent properties, it can be immediately put to use alone, but is usually used in admixture with weakly caking coal to obtain coke with splendid properties that compare well with the U.S. produced caking coal such as Beatrice or Ittman coal. An example of the properties of weakly caking coal usable in admixture with the product of the present invention is shown below:

| Properties of weakly caking coal | | | | |
|---|---|---|---|---|
| Moisture % | Ash % | Volatile content % | Fixed carbon | Coke strength ($DI_{15}^{30}$) |
| 1.9 | 6.6 | 41.0 | 50.5 | 65 |

The general properties of synthetic caking coal obtained according to the method of the present invention are as follows:

| General properties of synthetic caking coal | | | | | |
|---|---|---|---|---|---|
| Ash % | Volatile content % | Fixed carbon % | Dilatation (CSN) | Fluidity | Coke strength ($DI_{15}^{30}$) |
| 0.1–7 | 10–32 | 68–88 | 4–9 | 3,000–30,000 | 80–95 |

Generally, coke production is carried out by blending the product of the present invention in an amount of about 5 to about 50 wt.% with weakly or non-caking coal and then carbonizing the blend by an ordinary coking method. The strength of the product coke is affected by the kind of the blended coal as in the case of various types of strongly caking coal. In case of using strongly caking coal of the U.S. product, high strength of 90 to 92 in $DI_{15}^{30}$ is obtained. And in the case of the present invention it is possible to obtain equal or even higher strength than the above mentioned by using synthetic caking coal obtained according to the method of the present invention. Coking can be accomplished by using the same conditions as generally employed for production of coke.

The present invention is described in further detail in reference to the accompanying drawing.

Non-caking or weakly caking raw coal is finely pulverized into fine pieces of a particle size of less than 1.5 mm and then put into a slurry tank 1 together with a solvent, such as anthracene oil, to form a slurry. The solvent is added in an amount of about 1.5 – about 3.0 weight parts per 1 weight part of coal. The slurry is pressurized with hydrogen gas to 70 to 150 atm by a pump 2 and then led into a preheater 3 where the mixture is heated to 350° to 500° C. The flow rate is preferably 0.5 to 1 of space velocity. The mixture is then guided into a hydrogenolysis reactor where hydrogenolysis is carried out under the above-said conditions, whereby coal is dissolved while absorbing hydrogen at about 0.5 to 3%. Organic sulfur in the coal is combined with hydrogen to become hydrogen sulfide and is thereby separated. After reducing the pressure to 3.5 atm the reaction product is subjected to filtrate in a filter 5 at a temperature of 250° to 300° C to filter out ash, undissolved material and other impurities. The filtrate is subjected to flash distillation in a flash evaporator 6 to produce a molten product. The evaporated component enters a disillating tower 7 whereby the light oil component (having a boiling point of less than 280° C) is distilled off from the top while the distilled solvent is returned to the slurry tank 1 as circulating oil. The gas discharged from the filter 5 is refined by a gas purifier 10, hydrogen gas being recirculated for reuse.

The separated product, in a molten state, is added with 0 to 2.5 weight % of aluminum chloride as catalyst and fed into a polymerizer 8 where the mixture is allowed to undergo polymerization at a temperature of 380° to 500° C. As a result of said polymerization treatment, a part of the said mixture is converted into a low boiling material, which enters a cooler 9 and is recovered therefrom. But the main product of the second step, namely the polymerized product forms caking coal, and is taken out as the end product (hereinafter referred to synthetic caking coal).

This synthetic caking coal has softenmeltability and dilatability, and thus has properties closely akin to those of ordinary caking coal, and hence if this is used in a blend with weakly caking coal, there can be obtained excellent iron manufacturing coke.

The composition of raw coal used and the composition of the hydrogenolysis product obtained in the first step are in Table 1.

Table 1

| Compositional analyses of raw coal and product in the first step | | | | | | |
|---|---|---|---|---|---|---|
| Raw coal (weakly caking coal prod. in Australia) | | | | | | First-step product |
| Proximate analysis | | | Ultimate analysis | | | Ultimate product |
| Moisture | (%) | 3.0 | Carbon | (%) | 72.2 | 88.7 |
| Ash | (%) | 8.0 | Hydrogen | (%) | 5.3 | 5.8 |
| Volatile | (%) | 36.9 | Nitrogen | (%) | 1.5 | 1.6 |
| Fixed carbon | (%) | 52.1 | Oxygen | (%) | 11.7 | 3.5 |
| Dilatation | (CSN) | 1 | Sulfur | (%) | 0.8 | 0.4 |
| | | | Ash | (%) | 8.5 | 0.3 |

The first-step product had a melting point of 120° C (as measured by the ring and ball method). The melting point of the obtained hydrogenolysis product can be adjusted at will by controlling the degree of hydrogenolysis and the degree of solvent recovery. As a result of polymerization generates oil gas or light oil in the course of the polymerization reaction and it can be easily removed in the final step of treatment. Although it is usually desirable to recover the solvent used in the first step as much as possible, it is also advisable to allow some of such solvent to remain in the product so as to obtain a material having an optimal melting point. If a catalyst such as Co-Mo or iron type catalyst is used in hydrogenolysis, it is possible to carry out the reaction at a relatively low temperature.

Synthetic caking coal obtained from the second polymerization step varies in properties such as volatile content, dilatation (CSN) and fluidity depending on the polymerization temperature or treating time. Table 2 below shows the results of a series of experiments where the product obtained in the first step, shown in Table 1, were used as specimens and the polymerization temperature was varied between 430°–470° C while the reaction time was fixed at about 10 minutes.

Table 2

| Relationship between treating temperature in the polymerization step and the properties of synthetic caking coal obtained | | | | | |
|---|---|---|---|---|---|
| Polymerization temperature (° C) | 430 | 440 | 450 | 460 | 470 |
| Properties of obtained caking coal | | | | | |
| Volatile (%) | 35.6 | 29.5 | 26.7 | 22.5 | 18.5 |
| Dilatation (CSN) | 4 | 5 | 7 | 6 | 2 |
| Flow-point (° C) | 230 | 250 | 280 | 325 | 400 |
| Max.Fluidity (ddpm) | 30,000 | 30,000 | 30,000 | 30,000 | 150 |

It is therefore possible to adjust the volatile content and fluidity as desired by selecting the type of coal blended in the process for production of coke.

Tests were also carried out on blending of different kinds of coal in production of coke. 30 weight % of synthetic caking coal (with volatile content of 22.5%) obtained by the 460° C treatment in Table 2 was blended with 70 weight % of weakly caking coal produced in Japan, Akabira coal which has 1.9% of moisture content, 6.6% of ash, 41% of volatile, and coke strength of ($DI_{15}^{30}$ 65, and this blended coal was subjected to the coking process. There was obtained a cole having a strength of ($DI_{15}^{30}$) 90. For the sake of comparison, U.S-produced strongly caking coal was used instead if the synthetic caking coal used in the above, and this strongly caking coal was similarly blended with said weakly caking coal and subjected to a similar coking process, and the strength of resultantly obtained coke was measured and found to be 90 ($DI_{15}^{30}$). These results indicate that the synthetic caking coal produced according to the method of the present invention has properties comparing well with the U.S.-produced strongly caking coal.

The fluidity of coals imported by Japan has been decreasing in recent years. This is due to the fact that imported Canadian coal and Australian coal are relatively low in fluidity. Good-quality coke is difficult to obtain flow low-fluidity coal, so that the iron manufacturers are demanding caking coal having high fluidity. Synthetic caking coal obtained by the present invention has extremely high fluidity as seen in the above tables. So, by putting this characteristic to use in the field of the coking industry, it is possible to solve this problem of reduced fluidity and to obtain high-quality coke.

Although the process of the present invention includes a step for ash removal by filtration, this step is not always necessary. If ash is contained at a small proportion in synthetic caking coal, there occures no impediment to actual use as understood from the fact that iron manufacturing coke currently used in industrial manufacture of coke contains ash at about 10%, Thus, this step may be excluded depending on the purpose of use of the product.

The present invention is now described in greater detail by way of some preferred examples.

EXAMPLE 1

Australian brown coal briquette (moisture content 15%, ash content 1.6%, volatile content 42%, dilatation (CSN) 0) was crushed to a particle size of less than 10 mesh and anthracene oil was added thereto in an amount of about 2.5 times that of the coal by weight to form a slurry. This slurry was placed in a heater and heated at 450° C under 70 atm in a hydrogen stream for 1 hrs. After the reaction had finished, the mixture was taken out, and after removing non-reacted material and ash by filtration, anthracene oil was separated by distillation to obtain a primary product. This primary product was placed in a separate container, heated to 430° C under normal pressure under nitrogen atomsphere and maintained at that temperature for 60 minutes. Thereafter, the product was cooled and then withdrawn as end product. This end product had volatile content of 28% and dilatation of 7. Fluidity of this product was also determined by a Gieseler plastometer according to JIS M 8801, revealing maximum fluidity of about 30,000 ddpm. The product also had all other properties required of strongly caking coal.

EXAMPLE 2

Similar test were conducted on HABORO coal which is a non-caking coal produced in Japan. This non-caking coal has 13.5% water content, 7.1% ash content, 41.4% volatile content and 0 dilatation (CSN). This coal was crushed to a size of less than 10 mesh and anthracene oil was added thereto in an amount about 2.0 times that of coal by weight to form a slurry. This slurry was put in a heater and treated at 400° C under 150 atm in the atmosphere of hydrogen stream for 1 hrs. After the reaction had finished, the mixture was taken out, and after removing nonreacted materials and ash by filtration, anthracene oil was removed by reduced pressure distillation to obtain a primary product. This primary product was placed in a separate container, added with aluminium chloride as catalyst, heated to 430° C and maintained at that temperature for about 40 minutes under nitrogen atmosphere. The product was then cooled and withdrawn as end product. Analysis of this end product showed 22% of volatile content, 8 of dilatation and 20,000 ddpm maximum fluidity. It also is possessed of all other properties required for strongly caking coal.

EXAMPLE 3

Similar test were also made on HORONAI coal, or slightly caking coal produced in Japan. This coal which has a water content 4.8%, ash content 7.6%, volatile content 41.1% and dilatation (CSN) 1 was crushed in the same way as Example 2 to form a slurry, and this slurry was added with an iron catalyst and placed in a heater to undergo heating treatment at 380° C under 80 atm under the atmosphere of a hydrogen stream for 1 hrs. After the reaction, the product was taken out, and after removing non-reacted materials and ash by filtration, anthracene oil was separated to obtain a primary product. This primary product was placed in a separate container, heated to 420° C under nitrogen atmosphere and maintained at that temperature for about 50 minutes, followed by cooling and withdrawl of the product as end product. This end product showed volatile content of 32%, dilatation of 6 and maximum fluidity of 30,000 ddpm, proving that it has the same properties as that of naturally occuring strongly caking coal.

What we claim are:

1. Synthetic caking coal which comprises being obtained by hydrogenating weakly or non-caking coal in the presence or absence of a catalyst to obtain a primary product and then heat-polymerizing the said primary product preferably under non-oxydizing atmosphere in the presence or absence of a catalyst to obtain synthetic caking coal.

2. Synthetic caking coal according to claim 1 which comprises hydrogenating at a temperature of about 300° to about 500° C under a hydrogen pressure of 70–150 atm in the presence of catalyst to obtain the said primary product.

3. Synthetic caking coal according to claim 1 which comprises hydrogenating at a temperature of about 350° to about 500° C under a hydrogen atmosphere of 70 to 150 atm in the absence of catalyst to obtain the primary product.

4. Synthetic caking coal according to claim 1 which comprises heat-polymerizing the primary product at a temperature of about 350° to 450° C.

5. Process for producing synthetic caking coal which comprises the following steps (1) adding finely pulverized weakly or non-caking coal to a solvent to form a slurry, hydrogenating the slurry in the presence or absence of hydrogenating catalyst under a high pressure hydrogen gas atmosphere, separating coal hydrogenated product, and then (2) heat-polymerizing the hydrogenated product in the presence or absence of a polymerizing catalyst at an elevated temperature preferably under an inert atmosphere, discharging and cooling the reaction product.

6. Process for producing synthetic caking coal according to claim 5 wherein the hydrogenation is carried out at a temperature of about 300° C to 500° C under a hydrogen pressure of about 70 to about 150 atm.

7. Process for producing synthetic caking coal according to claim 5 wherein the said hydrogenated product has a softening point of about 80° C to about 180° C preferably about 100° C to about 150° C.

8. Process for producing synthetic caking coal according to claim 5 wherein the heat-polymerization is carried out at a temperature of about 350° to about 500° C, preferably about 400° to 450° C.

* * * * *